US005428869A

United States Patent [19]

Holubec et al.

[11] Patent Number: 5,428,869

[45] Date of Patent: Jul. 4, 1995

[54] DEVICE FOR FILLING NON-CIRCULAR CANS WITH A TEXTILE SLIVER

[75] Inventors: Leos Holubec; Josef Vitak, both of Liberec, Czechoslovakia

[73] Assignees: Elitex Usti Nad Orlici s.p.; Vyzkumny Ustav Textilnich Strou A.S., both of Liberec, Czechoslovakia

[21] Appl. No.: 135,177

[22] Filed: Oct. 8, 1993

[30] Foreign Application Priority Data

Oct. 8, 1992 [CS] Czechoslovakia ..... 3068-92

[51] Int. Cl.[6] ..... D04H 11/00

[52] U.S. Cl. ..... 19/159 R; 19/159 A

[58] Field of Search ..... 19/159 R, 159 A, 150, 19/157; 100/82, 83, 84, 85; 198/339.1, 736

[56] References Cited

U.S. PATENT DOCUMENTS 3,339,244 9/1967 Van Deusen ..... 19/159 R
5,237,726 8/1993 Gartenmann et al. ..... 19/159 R

FOREIGN PATENT DOCUMENTS 270164 6/1988 European Pat. Off. .
340459 11/1989 European Pat. Off. .
551223 5/1932 Germany ..... 19/159 R
347448 4/1931 United Kingdom ..... 19/159 R
971765 11/1982 U.S.S.R. ..... 19/159 R

*Primary Examiner*—Clifford D. Crowder
*Assistant Examiner*—Michael A. Neas
*Attorney, Agent, or Firm*—Ostrolenk, Faber, Gerb & Soffen

[57] ABSTRACT

A device for filling a series of non-circular cans, which are disposed on a conveyor, with sliver from a sliver producing textile machine. A coiler for delivering sliver to the cans is supported on an ancillary frame which is, in turn, supported for movement on a main frame. The cans are supported on the conveyor that moves past the coiler in a direction perpendicular to the long axis direction of the respective cans. A double acting piston cylinder arrangement moves the coiler and a cover over the can in which the coiler is disposed along the path of movement of the conveyor for moving the coiler over the can to be filled. The cover and can coiler together are moveable along the long axis plane of each of the cans by a drive for moving the coiler to deliver the sliver into the can.

8 Claims, 1 Drawing Sheet

DEVICE FOR FILLING NON-CIRCULAR CANS WITH A TEXTILE SLIVER

BACKGROUND OF THE INVENTION

1. Field of the Invention

The present invention relates to a device for filling non-circular cans with sliver on a sliver producing textile machine. The device permits substitution of empty cans for filled cans without feed interruption and without feed speed reduction even at high feed speed, and the device can be used in sliver producing textile machines. The device includes a can coiler mounted over individual non-circular cans. The non-circular cans are placed on a conveyor with their longitudinal axis plane perpendicular to the direction of movement of the conveyor and the coiler is moved over and then along each can.

2. State of the Art

In spinning mills, especially in those equipped with open-end spinning machines, circular cans for transporting the sliver from a first, sliver producing machine to a next, sliver processing machine have been lately increasingly replaced by non-circular cans. The non-circular cans are advantageous especially for automation of the production processes in spinning mills, because they have a large volume, can be easily oriented with precision, and can be positioned in a row next to each other in a sliver processing machine. One non-circular can is placed under each working place of the machine.

Two methods are known of filling non-circular cans. As described, for instance, in EP 270,164 or in EP 340,459, emptied non-circular cans are filled at the same place of an open-end spinning machine from a special device supplying a large amount of sliver. This device includes a special mechanism which places a suitable amount of sliver into the can from the supplied larger amount.

The sliver deposition into the non-circular can is performed by a coiling device equipped either with a head for simple sliver coiling or deposition or with a revolving can coiler. The mechanism for pushing the non-circular can from under its working place also ensures its correct position during the sliver coiling. After the coiling process is completed, the displacing mechanism pushes the filled can back under the working place of the spinning machine.

The drawback of this device is that during the displacement of the set sliver amount into the non-circular can, the working place of the spinning machine is out of action.

Transporting the big sliver amount and placing it into an empty can causes unsuitable handling of the sliver produced in acceptable quality on a carding or drawing machine since it involves irreversible changes in the cross section of the sliver and mutual displacement of the sliver fibers. This impairs the conditions of its subsequent processing on an open-end spinning machine, leads to rupture of sliver and causes sections of decreased sliver diameter, and thus reduces the general quality of the yarn produced.

In another known method of filling non-circular cans, the sliver is deposited into the cans directly on the sliver producing machine, which can be a carding or a drawing machine. When they have been filled, the non-circular cans are transported to an open-end spinning machine to replace the emptied cans.

During the coiling of the sliver into a non-circular can, a can coiler is seated on the outlet of the sliver producing device. The non-circular can is positioned under the can coiler in a device which displaces the can in the direction of its longitudinal axis. Due to the reversing rectilinear motion of the non-circular can with respect to the turning can coiler, the sliver is deposited into the non-circular can in cycloidal curves.

The mechanism producing the reversing rectilinear motion of the non-circular can is considerably strained and must be so dimensioned and of sufficient strength for supporting the full mass of the non-circular can filled with sliver. Moreover, the mechanism is rendered still more complex by including a device for lifting the movable bottom of the non-circular can.

Still another drawback of the prior mechanism is the necessity to reduce the filling speed during the interval of replacement of the full can with an empty one in order to prevent a considerable amount of sliver from being delivered outside the non-circular can to be filled. This amount of sliver that escapes depends on the speeds of its deposition. In fact, at high speed, the sliver that escapes between the non-circular cans may lock the whole device.

Abrupt speed reduction of the sliver producing machine, e.g., of a carding or drawing machine, unfavorably affects the quality of the sliver. Therefore, the invention tries to create a device for depositing by coiling the sliver into non-circular cans and permitting exchange of the cans without reducing the speed of the sliver producing machine and maintaining its high speed.

SUMMARY OF THE INVENTION

It is an object of the present invention to provide a device for filing non-circular cans with sliver and avoids the above drawbacks of the prior art.

The above drawbacks of the state of art are overcome by the invention comprising a device for filling non-circular cans with sliver on a sliver producing textile machine. The device comprises a principal frame which supports a can coiler mounted over a non-circular can. The can coiler is mounted displaceably in the direction of the plane of the long axis of the non-circular can. The can coiler may be mounted on an ancillary frame seated on fixed guiding means of the ancillary frame. It is coupled with a displacing mechanism for the ancillary frame which displaces the can along the path along which the cans are conveyed.

In a preferred embodiment, the displacing mechanism of the ancillary frame comprises two double acting pneumatic cylinders.

In another preferred feature, the can coiler is slidingly mounted on guiding means of the can coiler and is coupled with a carrier of the can coiler.

The carrier of the can coiler can be made as a motion causing screw connected with a reversing drive.

Also, the can coiler can be connected with a movable cover over the can and seated in the ancillary frame.

Other features and advantages of the present invention will become apparent from the following description of the invention which refers to the accompanying drawings.

BRIEF DESCRIPTION OF THE DRAWINGS

An embodiment of a device for filling non-circular cans with a textile sliver according to the invention is shown schematically in the accompanying drawings wherein.

DESCRIPTION OF A PREFERRED EMBODIMENT

Figure 1:
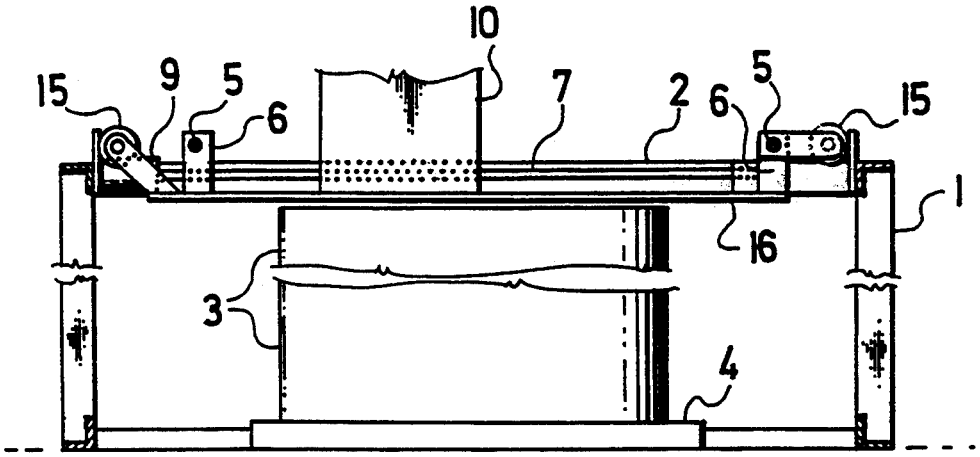
FIG. 1 is a front view of the device.
Figure 2:
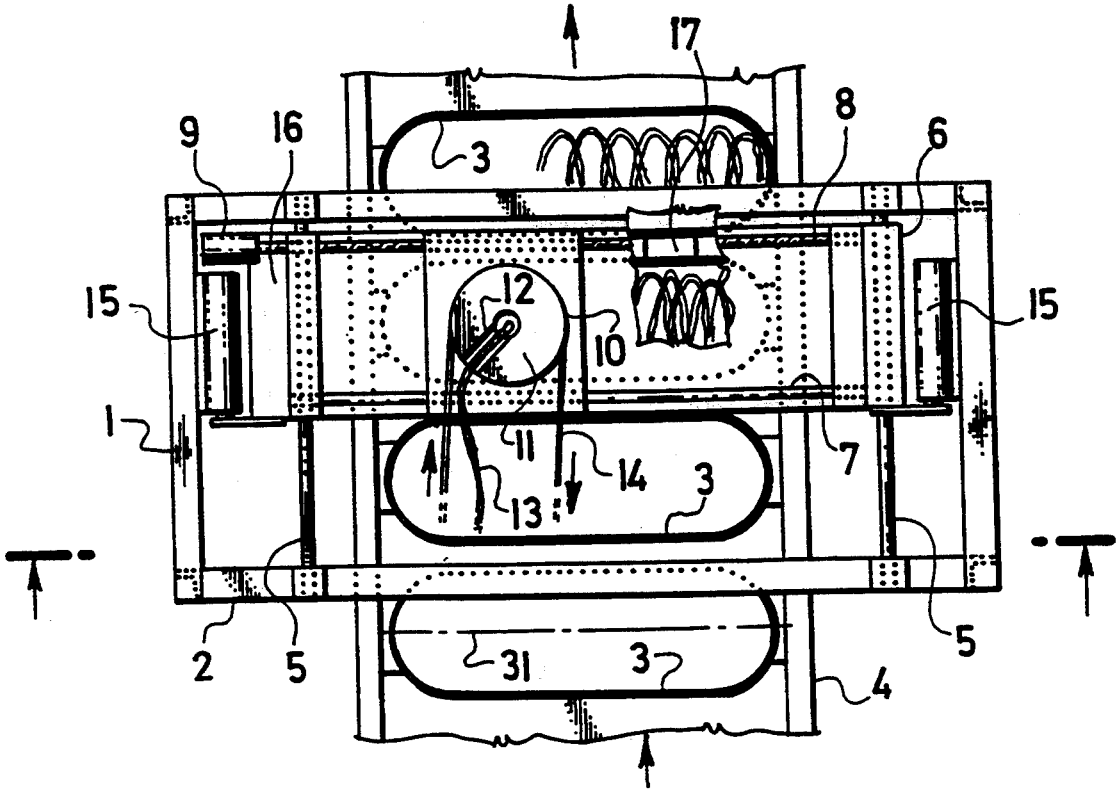
FIG. 2 is a plan view thereof.

The device for filling non-circular cans with a textile sliver comprises a principal frame 1 of bar construction including upper supporting bars 2 which are taller than a non-circular can 3. A conveyor 4 for the non-circular cans 3 is arranged in the lower part of the frame 1. For example, the conveyor is in the form of a sliding grid. However, it also can be made in other known ways. The non-circular cans 3 are seated on the conveyor 4 in an orientation in which their respective long lateral axis planes 31 are each perpendicular to the direction of motion of the conveyor 4. The non-circular cans 3 are held on the conveyor 4 in a known way.

Two guiding means 5 for an ancillary frame are mounted between the upper supporting bars 2 and extend parallel to the direction of motion of the conveyor 4 of the non-circular cans. An ancillary frame 6 is slidingly mounted on the guiding means 5. That frame 6 comprises guiding means 7 of the can coiler which is mounted perpendicular to the direction of motion of the conveyor 4 of the non-circular cans 3, i.e., parallel to the longitudinal axis planes 31 of the non-circular cans 3 placed on the conveyor 4. A can coiler carrier 8 made, for instance, as a motion screw is mounted on the ancillary frame 6 parallel to the guiding means 7 of the can coiler. The can coiler carrier 8 is coupled with a reversing drive 9 which is adapted to turn clockwise and counterclockwise to drive the carrier 8 in both directions.

A can coiler 10 is mounted on the guiding means 7 and is also coupled with the carrier 8. It comprises a can coiler plate 11 which is mounted rotatably and is fitted with a slanted outlet tube 12 through which a textile fiber sliver 13 passes the fiber comes, e.g. from a not illustrated carding machine.

The can coiler plate 11 is coupled in a known manner, for instance by a drive belt 14, with a not illustrated drive mechanism.

A shifting device is positioned at the ancillary frame 6. It comprises two double-acting pneumatic cylinders 15 mounted on the principal frame 1 and extending parallel to the guiding means 5 of the ancillary frame. The pneumatic cylinders 15 are situated on opposite sides of the ancillary frame 6. Their pistons are connected by laterally extending connecting means with the ancillary frame 6. The internal space of the pneumatic cylinders 15 is connected through a not shown control mechanism with a not shown pressure medium source. The limiting shift positions of the ancillary frame 6 correspond at least to the distance between the longitudinal axis planes 31 of two neighboring non-circular cans 3 placed on the conveyor 4.

The ancillary frame 6 includes a movable closed cover 16 which is interrupted only by the hole for the can coiler plate 11. The cover 16 is connected with the can coiler 10. It prevents a sliver from being deposited outside the non-circular can 3 then being filled. A mechanism 17 is mounted on the ancillary frame 6 for severing the sliver 13 outside the sliver receiving non-circular can 3.

In a known way, the sliver 13 is fed from a sliver producing machine, for instance from a carding machine, to the can coiler 10 where it is introduced into the slant outlet tube 12 on the revolving can coiler plate 11. The slant outlet tube 12 is positioned so that its inlet hole lies in the axis of the can coiler plate 11, and its outlet hole is on a radius equal to one half the width of the non-circular can 3, reduced by approximately the diameter of the sliver being coiled.

Simultaneously with the rotation of the can coiler plate 11, the can coiler 10 carries out a reversing rectilinear motion across the whole length of the sliver receiving can 3 so that the sliver 13 is deposited in cycloidal curves. The length of this reversing rectilinear motion, generated by the reversing rotation of the reversing drive 9 of the carrier 8, is equal to the difference between the length and the width of the non-circular can 3.

During its reversing rectilinear motion over the non-circular can 3, the can coiler 10 moves on the guiding means 7, and since the can coiler is connected with the movable cover 16, the space over the non-circular can 3 is closed except for the plate 11 of the can coiler 10, thus eliminating the risk that the sliver 13 will be laid outside the sliver receiving, non-circular can 3.

When the sliver receiving non-circular can 3 placed under the can coiler 10 is full, the shifting device of the ancillary frame 6 is activated and very quickly shifts the ancillary frame 6 to be over the next, usually neighboring empty non-circular can 3, so that the can coiler 10 comes over the empty non-circular can 3 without stop or speed reduction of the rotation speed of the can coiler plate 11 whereupon the sliver 13 is severed. The feed speed of the sliver 13 passing through the outlet tube 12 of the can coiler plate 11 remains at a constant speed and the sliver is deposited in the empty sliver receiving non-circular can 3.

Then the conveyor 4 of the non-circular cans 3 begins to shift, and the shifting device of the ancillary frame 6 brings the ancillary frame 6 back to its initial operating position with the same speed as the speed of movement of the conveyor 4 of the non-circular cans 3. When the ancillary frame 6 reaches its initial operating position, the non-circular can 3 is also in its filling position. The motion of the conveyor 4 of the non-circular cans and of the shifting device of the ancillary frame 6 stops. Throughout the reverse motion of the ancillary frame 6, the axis of rotation of the can coiler plate 11 lies uninterruptedly along the long axis plane 31 of the non-circular can 3.

In the example of embodiment, the shifting device of the ancillary frame 6 comprises of two pneumatic cylinders 15 but other devices may be used.

Although the present invention has been described in relation to a particular embodiments thereof, many other variations and modifications and other uses will become apparent to those skilled in the art. It is preferred, therefore, that the present invention be limited not by the specific disclosure herein, but only by the appended claims.

What is claimed is:

1. A device for filling non-circular cans with sliver on a sliver producing textile machine, the device comprising:

a frame including a space for passage of the non-circular cans;

a conveyor in the space including means for transporting the cans and for positioning the cans so that each of their long axis planes is perpendicular to the direction of movement of the conveyor past the coiler;

can coiler supporting means on the frame and above the cans;

a can coiler supported on the supporting means for coiling sliver over a non-circular can;

means for moving the can coiler linearly and reversibly over a respective non-circular can during can filling; and a can plate mounted for rotation in the can coiler as the can coiler moves linearly reversibly during can filling.

2. The device of claim 1, wherein the can plate has a rotation axis which lies in a long axis plane of the can being filled.

3. The device of claim 2, further comprising an ancillary frame supported on the frame for receiving the supporting means for the can coiler;

a displacing device connected with the ancillary frame for shifting the ancillary frame selectively perpendicular to the long axis of the non-circular cans.

4. The device of claim 3, wherein the displacing device of the ancillary frame comprises a double acting pneumatic cylinder connected between the frame and the ancillary frame for shifting the ancillary frame.

5. The device of claim 4, further comprising a carrier on the ancillary frame, a can coiler guide on the carrier and moveable along the carrier in the direction of the long axis plane of each can, and the can coiler being coupled with the carrier to be moveable on the guide.

6. The device of claim 3, further comprising a carrier on the ancillary frame, a can coiler guide on the carrier and moveable along the carrier in the direction of the long axis plane of each can, and the can coiler being coupled with the carrier to be moveable on the guide.

7. The device of claim 6, wherein the carrier comprises a dual directional motion screw on which the can coiler guide is supported for motion as the screw rotates;

a reversing drive connected with the screw for rotating the screw for moving the guide in opposite directions along the carrier.

8. The device of claim 7, further comprising a moveable cover seated in the ancillary frame and moveable along with the can coiler for covering the can, the coiler being disposed in the cover, whereby the cover prevents sliver from entering a can other than the can to which the coiler is to deliver sliver.

* * * * *